United States Patent [19]

Urquiola

[11] Patent Number: 5,067,183

[45] Date of Patent: Nov. 26, 1991

[54] CONVERTIBLE INFANT BED ASSEMBLY

[76] Inventor: Omar Urquiola, 235 SW. Le Jeune Rd., Miami, Fla. 33134

[21] Appl. No.: 663,967

[22] Filed: Mar. 4, 1991

[51] Int. Cl.[5] ..... A47D 11/00

[52] U.S. Cl. ..... 5/2.1; 5/93.2; 5/183; 5/308

[58] Field of Search ..... 5/2.1, 93.1, 93.2, 100, 5/201, 183, 184, 280, 285, 308

[56] References Cited

U.S. PATENT DOCUMENTS

| | | | |
|---|---|---|---|
| 198,155 | 12/1877 | Reed | 5/100 X |
| 2,501,309 | 3/1950 | Braver | 5/308 |
| 2,677,832 | 5/1954 | Christensen | 5/181 X |
| 2,721,336 | 10/1955 | Becker | 5/2.1 |
| 2,783,477 | 3/1957 | Tiltsworth | 5/2.1 |
| 2,787,007 | 4/1957 | Erdkamp | 5/2.1 |
| 3,299,450 | 1/1967 | Gottfried et al. | 5/100 |
| 4,361,919 | 12/1982 | Hull | 5/93.2 |
| 4,450,597 | 5/1984 | Hull . | |

*Primary Examiner*—Michael F. Trettel
*Attorney, Agent, or Firm*—J. Sanchelima

[57] ABSTRACT

A set of furniture pieces that form a crib in one configuration and that can be readily converted into youth bedroom furniture including night tables, shoe rack assembly and a dresser assembly including a chair assembly. The set includes a rectangular base assembly that can be extended when changing from the crib to the bed configuration. Platform members provide a horizontal supporting surface where a mattress is positioned. Removable rail assemblies, comprising two hingedly mounted sections sandwiched by fixed panel sections, are mounted to the upper edges of the base assembly. The hingedly mounted sections include upper and lower sub-sections that are hingedly mounted to each other whereas the fixed panel section includes upper and lower panels that are removably mounted to each other. A removable head board assembly is mounted to the base assembly and between the rails. Lower and upper chest assemblies are provided with cooperating dimensions and a storage compartment assembly is sandwiched between the upper and lower chest assemblies. The rails can be converted into head and feet board for the converted bed and as support members for the shoe rack assemblies. Upper and lower panel sections are used as divider/holders for the shoes and for the legs of a chair assembly that is formed with storage compartment assembly.

12 Claims, 5 Drawing Sheets

CONVERTIBLE INFANT BED ASSEMBLY

BACKGROUND OF THE INVENTION

1. Field of the Invention

The present invention relates to bed assemblies of the type that can be readily converted to the type that is most suitable to a baby, infant and youth, as he or she grows and his or her needs change.

2. Description of the Related Art.

Several bed assemblies have been designed in the past that can be converted from crib to youth bed in an attempt to avoid the costly expenditures of having to replace completely one set of furniture for another.

One of such attempts is described in U.S. Pat. No. 2,787,007 issued to Erdkamp in 1957. This patented invention differs from the present invention in that the chest of drawers represented in FIG. 2 is not subsequently used when the crib is converted into a bed. Furthermore, the height of the converted bed is the same as the height of the crib, which is inconvenient when used as a bed.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a convertible bed assembly that is volumetrically efficient while at the same time providing the functions of furniture generally used for babies and subsequently for young individuals.

It is another object of the present invention to provide a convertible bed assembly that closely tracks the dimensions of the crib and twin bed thereby accepting standard linen size.

It is yet another object of this present invention to provide such a device that is inexpensive to manufacture and maintain while retaining its effectiveness.

Further objects of the invention will be brought out in the following part of the specification, wherein detailed description is to fully disclose the invention without placing limitations thereon.

BRIEF DESCRIPTION OF THE DRAWINGS

With the above and other related objects in view, the invention consists of the details of construction and combination of parts, as will be more fully understood from the following description when read in conjunction with the accompanying drawings in which.

DETAILED DESCRIPTION OF THE PREFERRED EMBODIMENT

Figure 1:
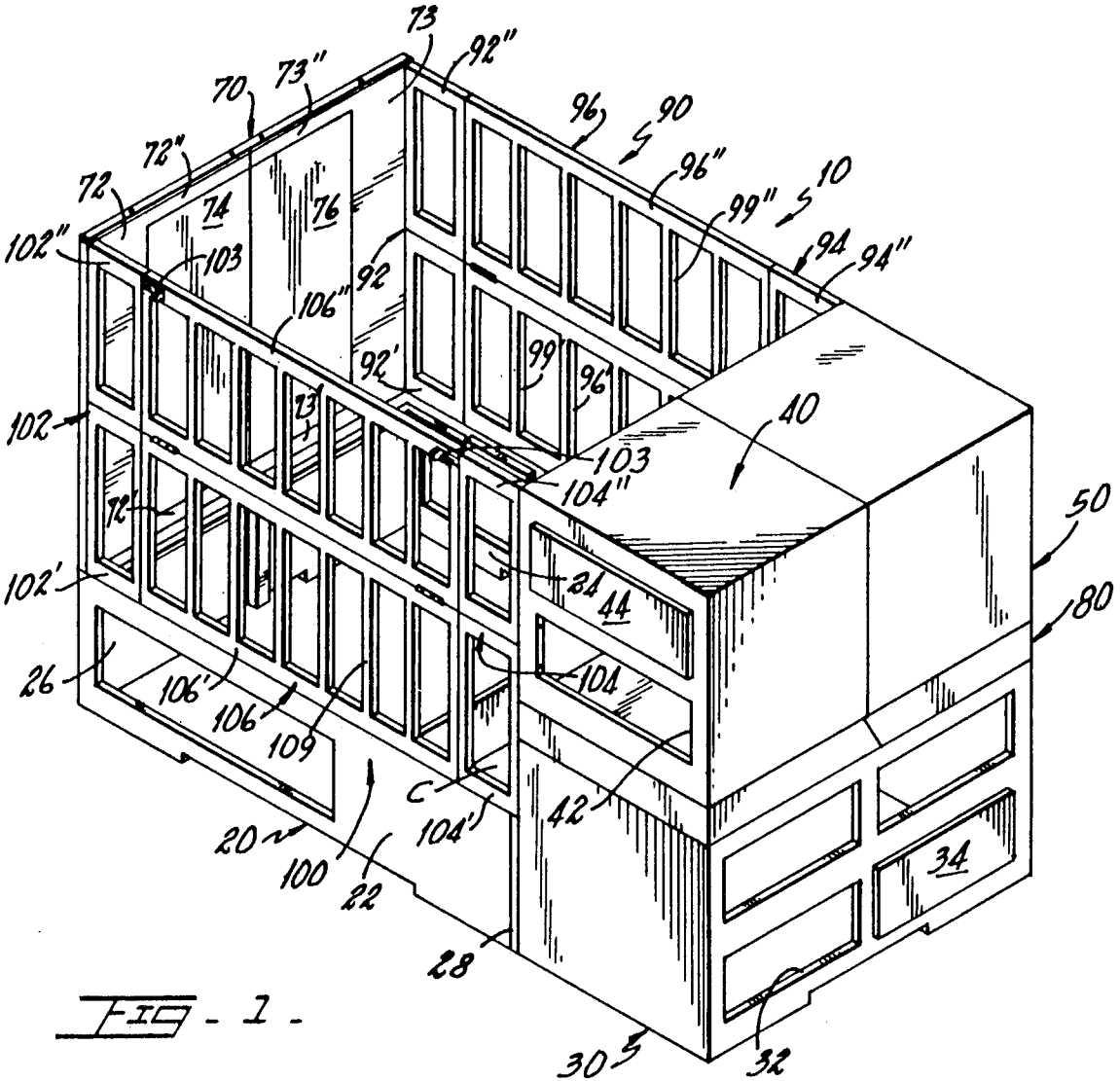
FIG. 1 shows an isometric view of the present invention in the crib configuration, with the platform members removed.
Figure 4:
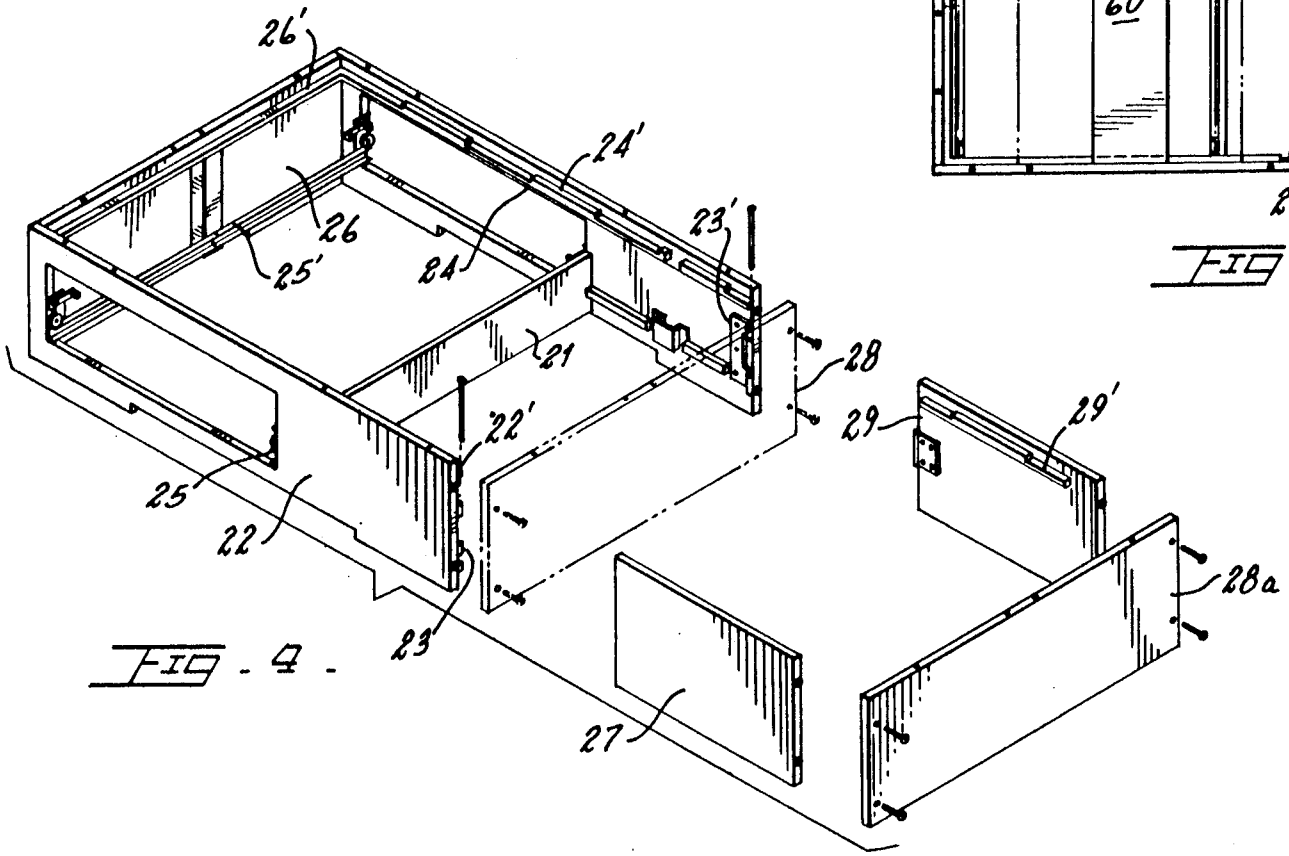
FIG. 4 represents an exploded isometric view showing the removal of end member 28, that is represented in phantom, and its mounting at the end with the extension members referenced with numeral 28*a* when the crib is configured into a bed.
Figure 6:
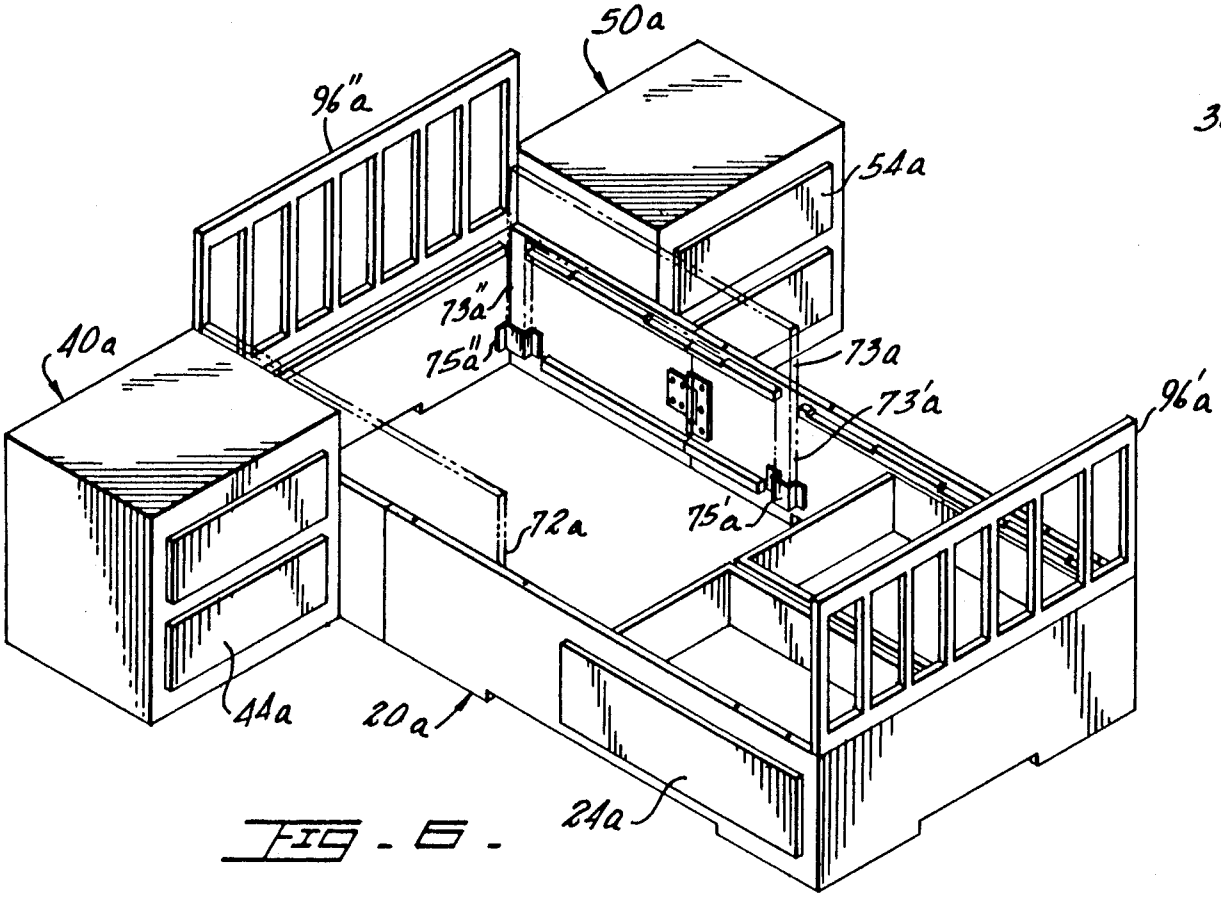
FIG. 6 is an isometric view of the bed assembly with two night tables, without the platform members.
Figure 8:
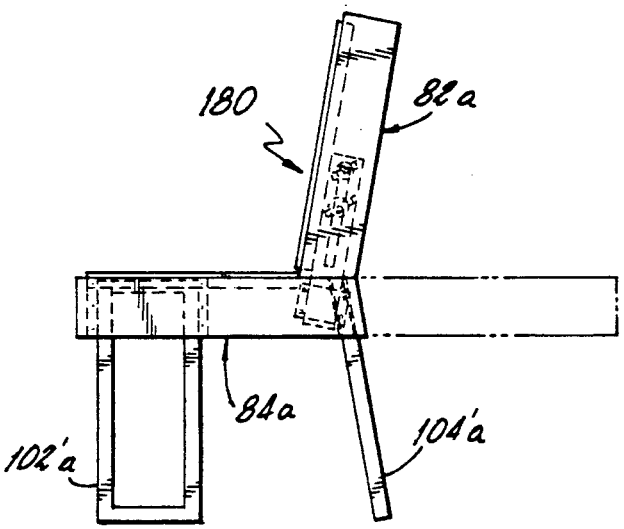
FIG. 8 is a side elevational view of the storage compartment assembly being converted to a chair used with the dresser assembly.
Figure 9:
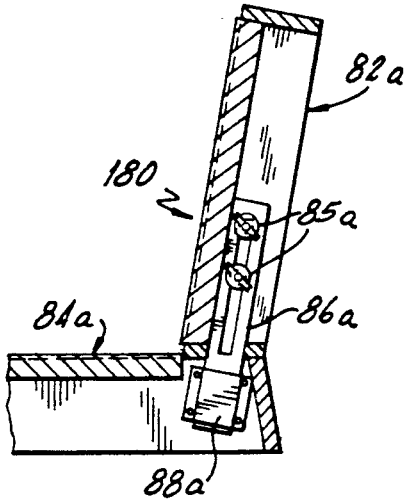
FIG. 9 is a detail cross-section view of a portion of the chair shown in the previous figure.
Figure 10:
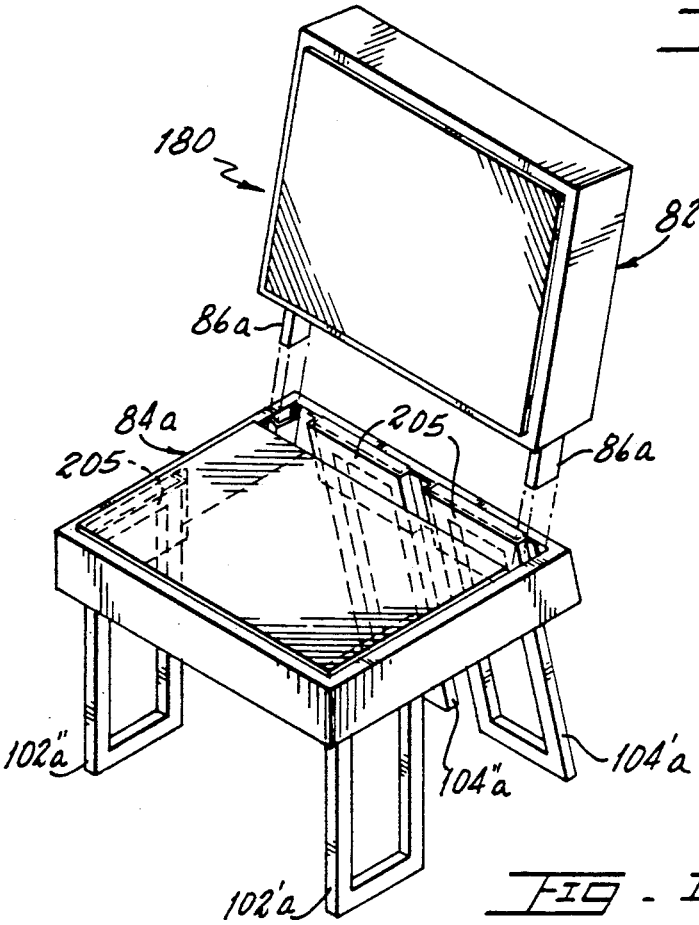
FIG. 10 is an isometric view of the chair represented in the previous two figures showing the insertion of the male section of the storage compartment slightly off a perpendicular relationship with the female section.

Referring now to the drawings where the present invention is generally referred to with numeral 10, it can be seen that it basically includes base assembly 20, lower chest assembly 30, left and right chest assembly 40 and 50, platform members 60 head board assembly 70 and rail assemblies 90 and 100. In FIG. 1, the invention is shown with the crib configuration, with platform members 60 removed. In the preferred embodiment a horizontal plane at a spaced apart relationship from the floor is defined alternating platform members 60 with spaces in between them. Base assembly 20 includes lateral members 22 and 24 as well as end members 26 and 28 (as is best seen in FIG. 4). Inner flange members 22', 24' and 26' are mounted to the inner surface of members 22, 24 and 26 to cooperatively receive and support platform members 60. Reinforcing member 21 includes drawer guiding assembly 25 that cooperates with similar drawer guiding assembly 25' to receive drawers 24*a*, as shown in FIGS. 4 and 6. Member 28 is removably mounted to the ends of members 22 and 24 so that, when converted, it is removed and mounted at the end of extension members 27 and 29, and indicated with numeral 28*a*. In the preferred embodiment, extension members 27 and 29 are removably and hingedly mounted to lateral members 22 and 24, respectively, through hinge assemblies 23 and 23'. Members 27 and 29 can be swung inwardly and stored inside base assembly 20 in the crib configuration, or stored inside compartment C or storage compartment assembly 80.

Figure 2:
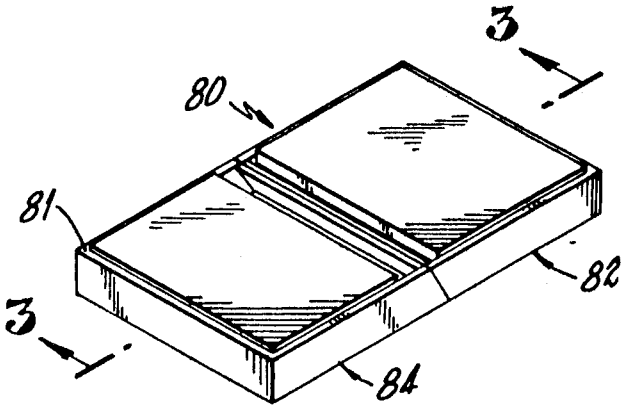
FIG. 2 is an isometric view of the compartment used to store the extension members used to convert the assembly to twin size bed.
Figure 3:
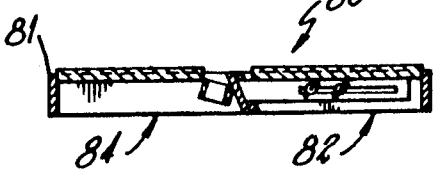
FIG. 3 represents a cross-sectional view of the compartment shown in FIG. 2, taken along the line 3—3.
Figure 7:
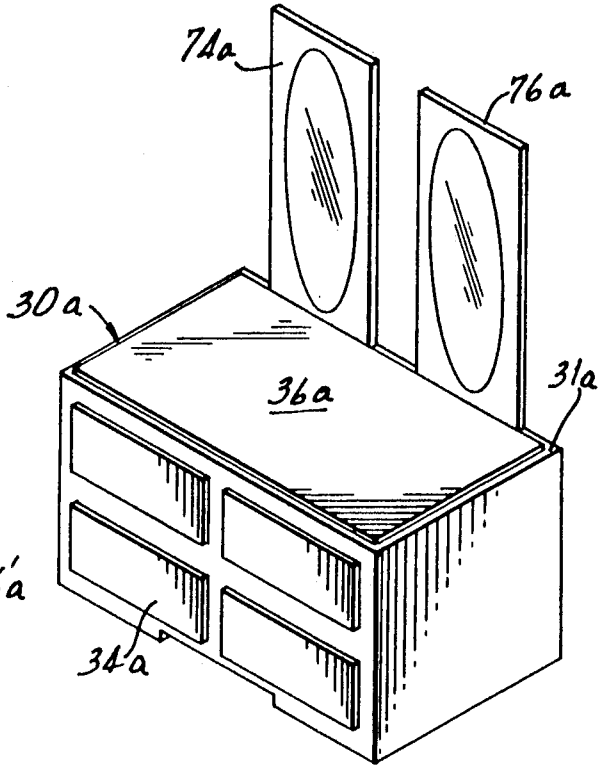
FIG. 7 represents the dresser assembly with the head boards provided with mirrors mounted thereon.

Storage compartment assembly 80 is positioned between lower chest assembly 30 and upper left and right chest assemblies 40 and 50 as shown in FIG. 1. Assembly 80, as seen in FIG. 2, can house extension members 27 and 29 that are mounted to members 22 and 24 when assembly 10 is converted to a youth bed. Also, it is possible to store members 27, 29 and 60 inside compartment C. Assemblies 30 and 80 have preferably the same floor plan projection which also coincides with the combined floor plan projection of assemblies 40 and 50. Assembly 80 includes male and female boxes 82 and 84 that lack a bottom surface in the preferred embodiment. The top surface of assembly 30*a* includes a recessed edge 31*a*, as shown in FIG. 7, over which assembly 80 fittingly rests. Similarly, the top surface of assembly 80 includes a recessed edge 81 that receives assemblies 40 and 50. Assemblies 30 and 40 include drawer openings 32 and 42 wherein drawers 34 and 44 are removably housed, as seen in FIG. 1. Similarly, assembly 50 includes drawers that are not seen in FIG. 1 but are represented in FIG. 6 with numeral 54*a*, along with drawers 34*a* and 44*a* corresponding to converted furniture assemblies 30*a* and 40*a*.

Figure 13:
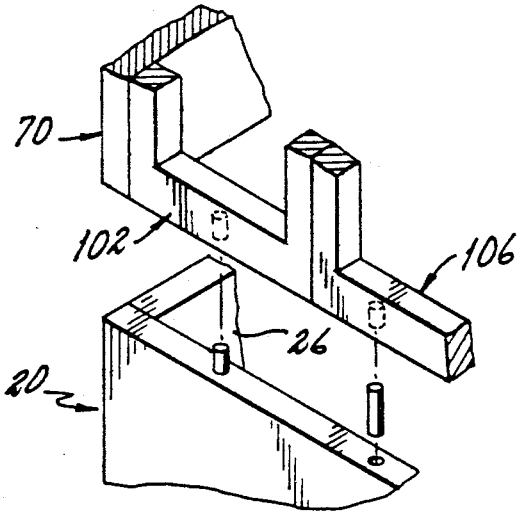
FIG. 13 is a detailed view showing the preferred manner of mounting the rail assemblies to the upper edge surface of lateral and members that form the base assembly.

Right and left rail assemblies 90 and 100 are removably mounted to base assembly 20 and they include fixed panel sections 92, 94, 102, 104 and hingedly joined panel sections 96 and 106. These fixed panel sections include lower and upper panels 92', 92", 94' (not shown in FIG. 1) 94", 102', 102", 104' and 104" and these lower and upper panels are removably mounted to each other. A representative mechanism for mounting these upper and lower panels is represented in FIG. 13. In the crib configuration, as seen in FIG. 1, fixed panel sections 92 and 102 are rigidly (albeit removably) mounted to the upper ends of members 22 and 24 and also to the inner surfaces of members 72 and 73 of head board assembly 70. Fixed panel sections 94 and 104 are removably mounted to the upper ends of members 22 and 24 and also to the rear outer surfaces of assemblies 30, 40 and 50. The mounting of these fixed panel sections can be preferably accomplished with screws.

Head board assembly 70 also includes mirror members 74 and 76 that preferably face outwardly in the crib configuration to avoid the risk of damaging the baby in the event of breakage. Mirror members 74 and 76 are framed by members 72 and 73 in the preferred embodiment.

Hingedly joined panel section 96 comprises lower sub-section 96' and upper subsection 96" which have substantially rectangular shapes including bars 99' and 99". Similarly, section 106 comprises lower and upper subsections 106' and 106" that include a sufficient number of bars 109 wherein their respective spacing with respect to each other is sufficiently small to prevent any child to fit through them. Lower subsection 96' and 106' are removably mounted to lower fixed panel members 92', 94' (not shown in FIG. 1), 102' and 104'. Upper subsection 96" and 106" are permitted to swing and they are locked in vertical alignment with upper fixed panel members 92", 94", 102" and 104" by latch assemblies 103.

Figure 11:
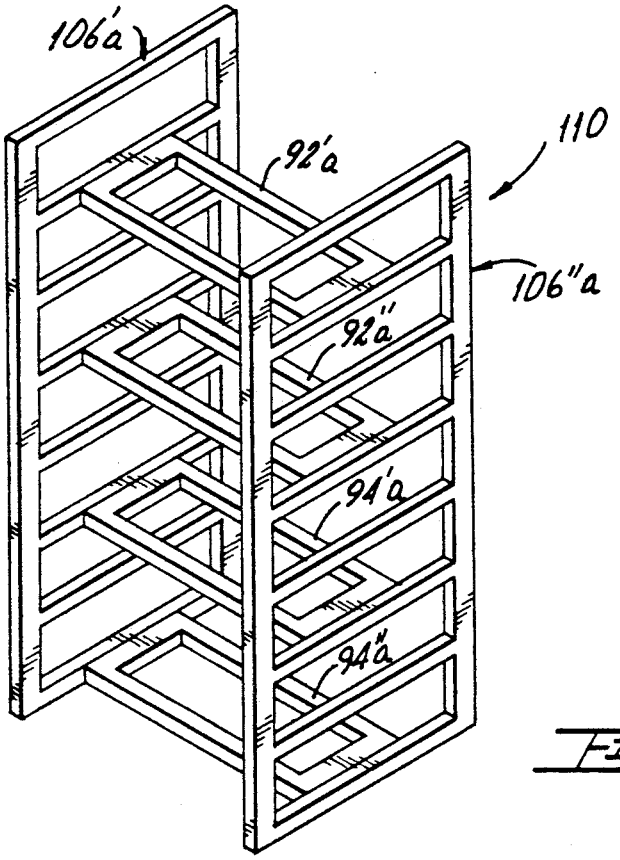
FIG. 11 is an isometric view of the shoe rack assembly configured from the rail assemblies of the crib.
Figure 12:
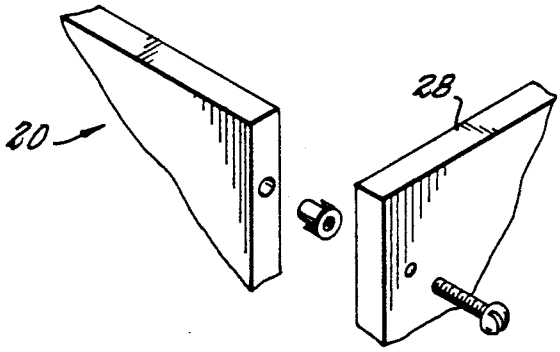
FIG. 12 shows a detail section of the preferred manner for mounting two board members as it is utilized in the present invention.

When a user converts the present invention from the crib configuration shown in FIG. 1 to the bedroom furniture shown in FIGS. 6 and 7, all members are used. Extension members 27 and 29 are stored in storage compartment C, storage compartment assembly 80 or inside base assembly 20. The resulting youth bedroom furniture includes youth bed assembly 20*a*, night table assemblies 40*a* and 50*a*, shoe rack assembly 110, dresser chair assembly 180 and dresser assembly 30*a*, as shown in FIGS. 6 through 11. Rail assembly sub-sections 96' and 96" are used to form head and feet board members 96'*a* and 96"*a*, as shown in FIG. 6. The other two subsections 106'*a* and 106"*a* are used as supporting members for shoe rack assembly 110, as seen in FIG. 11, with in between shoe holders formed with upper and lower panel sections 92', 92", 94' and 94" (referred to as 92'*a*, 92"*a*, 94'*a* and 94"*a*) and are mounted to sub-sections 106'*a* and 106"*a* keeping them in a spaced apart relationship.

Figure 5:
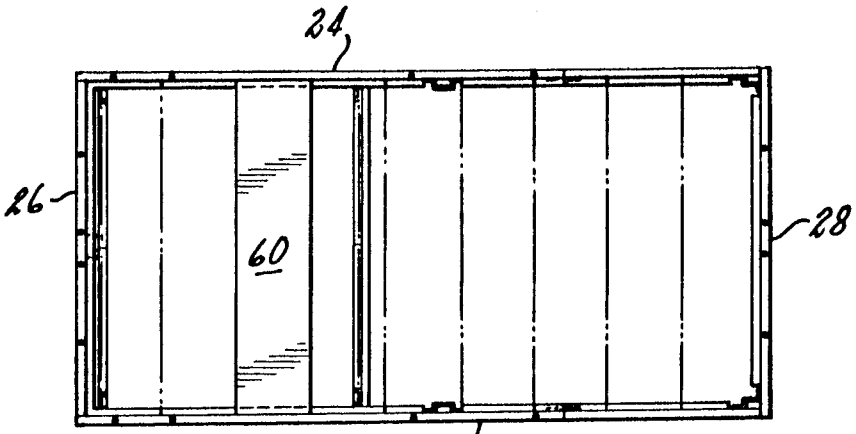
FIG. 5 shows a plan view of the bed showing one platform member 60 and the other platform members are represented in phantom.

Youth bed assembly 20*a* is built as shown in FIG. 4 by removing member 28 and mounting extension member 27 and 29. Finally, member 28 is mounted at the ends of members 27 and 29 as shown at 28*a*. The resulting base assembly is shown in the top view represented by FIG. 5. The additional platform boards 60 (stored inside base assembly 20) are added. Members 72 and 73 in the crib configuration become guard members 72*a* and 73*a* in the youth bed configuration, shown in FIG. 6. Legs 73'*a* and 73"*a* are removably received inside pocket members 75'*a* and 75"*a*.

Lower chest assembly 30 is converted to dresser furniture assembly 30*a* by mounting mirror board members 74*a* and 76*a* on the rear edge 31*a* of top 36*a*.

Dresser chair assembly 180 is formed with storage compartment assembly 80 which comprises two rectangular boxes 82*a* and 84*a* that cooperatively mate with each. Box 82*a* is denominated as a male box and includes telescopically extending internal tab member 86*a* that is removably inserted inside pocket 88*a* in female box 84*a*. In the preferred embodiment male frame 82*a* is mounted at an angle with respect to female member 84*a* that is close to being perpendicular and the angle will be one that would provide comfort to a user. Telescopically extending tab members 86*a* include two thumb nut members 85*a* that when tightened keep tab members 86*a* in place. Legs 102'*a*; 102"*a*; 104'*a* and 104"*a* are formed with upper and lower panels 102', 102", 104' and 104", and they are received by pockets 205.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A set of furniture pieces that are convertible from a crib to a youth bed with a dresser assembly, all resting on a horizontal floor, comprising in cooperative combination:

A. a base assembly including two lateral and two shorter end members having an upper edge and forming a rectangular frame and further including platform means mounted on top of said base assembly defining a horizontal plane, spaced apart from said floor and further including extension members removably mounted to said lateral members so that the length of said rectangular frame can be readily extended;

B. rail means removably mounted on the lateral members of said base assembly as an extension thereof and said rail means includes right and left rail assemblies and each one of said rail assemblies having one section comprising two rail members that are hingedly mounted to each other;

C. a head board assembly removably mounted on the upper edge of one of said end members of said base assembly as an extension thereof and also removably attached to said rail assemblies;

D. a lower chest assembly wherein its width is substantially the same as the length of said shorter end members, having a top surface and said lower chest assembly having a rear wall that is removably mounted to said other end member of said base assembly.

2. The set of furniture pieces set forth in claim 1 further including:

E. upper left and right chest assemblies abuttingly positioned with respect to each other and resting on said top surface.

3. The set of furniture pieces set forth in claim 2 wherein said lower and upper chest assemblies have a combined height that cooperatively forms with said rail means and head board assembly a rectangular framed area that prevents a baby from falling off said platform means.

4. The set of furniture pieces set in claim 3 wherein each one of said rail assemblies further includes two fixed panel sections having, each, two rectangular panel members sandwiching said hingedly mounted members so that the length of said hingedly mounted section is substantially the same as the width of said end members.

5. The set of furniture pieces set in claim 4 further including:

F. compartment means for storage having a plan projection substantially similar to said lower chest assembly and mounted thereon and said compartment means having an internal space that is capable of storing said extension members.

6. The set of furniture pieces set in claim 5 wherein said storage means includes two sections, referred to as male and a female sections, that are removably and coextensively mounted to each other and, when in the bed configuration, is capable of being also mounted substantially perpendicular to each other thereby defining a seat surface and a back surface and said storage means further including means for receiving rectangular panel members to form legs for supporting one of said sections defining said seat surface.

7. The set of furniture pieces set in claim 6 wherein said head board assembly includes mirror members and, when converted to the bed configuration, is removably mounted to said lower chest assembly.

8. The set of furniture pieces set in claim 7 wherein two of said hingedly mounted rail members are, when said set is converted to the bed configuration, kept in a spaced apart relationship by said rectangular panel members of said fixed panel sections which are removably mounted between said two hingedly mounted rail members so that a shoe rack assembly is thereby formed.

9. The set of furniture pieces set forth in claim 8 wherein said extension members are hingedly mounted to said lateral members so that when said set of furniture is in the crib configuration, said extension members can be stored inside said compartment means.

10. The set of furniture pieces set forth in claim 9 wherein said male section includes telescopic tab members housed within said internal space and capable of protruding outwardly from said male section for locking engagement with said female section.

11. The set of furniture set forth in claim 10 wherein said lower, upper left and upper right assemblies include each at least one drawer.

12. The set of furniture set forth in claim 11 wherein said head board assembly includes two legged members that frame said mirror members and when converted to the youth member configuration said legged members are removably mounted to said lateral end members thereby functioning as bed guards.

* * * * *